US009909202B2

(12) United States Patent
Zhang et al.

(10) Patent No.: US 9,909,202 B2
(45) Date of Patent: Mar. 6, 2018

(54) APPARATUS AND METHODS FOR SLURRY ALUMINIDE COATING REPAIR

(71) Applicant: General Electric Company, Schenectady, NY (US)

(72) Inventors: Liming Zhang, Greer, SC (US); Jere Allen Johnson, Jr., Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/268,464

(22) Filed: May 2, 2014

(65) Prior Publication Data

US 2015/0315694 A1 Nov. 5, 2015

(51) Int. Cl.

| | |
|---|---|
| ***C23C 16/00*** | (2006.01) |
| ***C23C 10/08*** | (2006.01) |
| ***C23C 10/14*** | (2006.01) |

(52) U.S. Cl.

CPC ..... *C23C 10/08* (2013.01); *C23C 10/14* (2013.01)

(58) Field of Classification Search

CPC ..... C23C 10/00; C23C 10/02; C23C 10/04; C23C 10/38; C23C 10/40; C23C 10/50

USPC ..... 427/250, 248.1

See application file for complete search history.

(56) References Cited

U.S. PATENT DOCUMENTS

| | | | |
|---|---|---|---|
| 4,004,047 | A | 1/1977 | Grisik |
| 4,687,684 | A | 8/1987 | Restall et al. |
| 4,761,267 | A | 8/1988 | Takeno et al. |
| 4,965,095 | A | 10/1990 | Baldi |
| 4,977,036 | A | 12/1990 | Baldi |
| 5,028,385 | A | 7/1991 | Baldi |
| 5,124,006 | A | 6/1992 | Fayeulle et al. |
| 5,224,941 | A | 7/1993 | Simmons |
| 5,261,976 | A | 11/1993 | Schultz |
| 5,264,245 | A | 11/1993 | Punola et al. |
| 5,364,659 | A | 11/1994 | Rapp et al. |
| 5,385,337 | A | 1/1995 | Schultz |
| 5,407,704 | A | 4/1995 | Basta et al. |
| 5,462,013 | A | 10/1995 | Punola et al. |
| 5,598,968 | A | 2/1997 | Schaeffer et al. |

(Continued)

FOREIGN PATENT DOCUMENTS

| | | |
|---|---|---|
| EP | 0 496 935 A1 | 8/1992 |
| EP | 0 933 448 A1 | 8/1999 |

(Continued)

OTHER PUBLICATIONS

European Search Report and Opinion issued in connection with corresponding EP Application No. 15165961.2 dated Oct. 15, 2015.

*Primary Examiner* — Kelly M Gambetta

(74) *Attorney, Agent, or Firm* — Dority & Manning, P.A.

(57) ABSTRACT

Methods for deposition of an aluminide coating on an alloy component positioned within a coating compartment of a retort chamber are provided. According to the method, the coating compartment is purged with an inert gas via a first gas line; a positive pressure is created within the coating compartment utilizing the inert gas; the coating compartment is heated to a deposition temperature; and at least one reactant gas is introduced into the coating compartment while at the positive pressure and the deposition temperature to form an aluminide coating on a surface of the alloy component. Retort coating apparatus are also provided.

14 Claims, 4 Drawing Sheets

(56) References Cited

U.S. PATENT DOCUMENTS

| | | | | |
|---|---|---|---|---|
| 5,658,614 | A | 8/1997 | Basta et al. | |
| 5,716,720 | A | 2/1998 | Murphy | |
| 5,788,823 | A | 8/1998 | Warnes et al. | |
| 5,789,089 | A | 8/1998 | Maki et al. | |
| 5,856,027 | A | 1/1999 | Murphy | |
| 5,989,737 | A | 11/1999 | Xie et al. | |
| 6,074,602 | A | 6/2000 | Wukusick et al. | |
| 6,110,262 | A * | 8/2000 | Kircher | C23C 10/26 106/14.21 |
| 6,129,991 | A | 10/2000 | Warnes et al. | |
| 6,136,451 | A | 10/2000 | Warnes et al. | |
| 6,143,361 | A | 11/2000 | Near et al. | |
| 6,153,313 | A | 11/2000 | Rigney et al. | |
| 6,168,874 | B1 | 1/2001 | Gupta et al. | |
| 6,224,941 | B1 * | 5/2001 | Chen | C23C 10/48 427/252 |
| 6,228,510 | B1 | 5/2001 | Chen et al. | |
| 6,258,461 | B1 | 7/2001 | Baldi et al. | |
| 6,273,678 | B1 | 8/2001 | Darolia | |
| 6,291,014 | B1 | 9/2001 | Warnes et al. | |
| 6,344,282 | B1 | 2/2002 | Darolia et al. | |
| 6,440,496 | B1 | 8/2002 | Gupta | |
| 6,472,018 | B1 | 10/2002 | Warnes et al. | |
| 6,482,469 | B1 | 11/2002 | Spitsberg et al. | |
| 6,495,271 | B1 | 12/2002 | Vakil | |
| 6,689,422 | B1 | 2/2004 | Warnes et al. | |
| 6,881,439 | B2 | 4/2005 | Graham et al. | |
| 6,905,730 | B2 | 6/2005 | Ackerman et al. | |
| 7,273,635 | B2 | 9/2007 | Purvis et al. | |
| 7,501,187 | B2 | 3/2009 | Warnes et al. | |
| 7,524,382 | B2 | 4/2009 | Fink et al. | |
| 2004/0151834 | A1 * | 8/2004 | Wustman | C23C 10/08 427/237 |
| 2004/0151836 | A1 * | 8/2004 | Wustman | C23C 10/08 427/253 |
| 2007/0141385 | A1 | 6/2007 | Rucker et al. | |
| 2008/0057193 | A1 * | 3/2008 | Mantkowski | C23C 10/08 427/237 |
| 2008/0193657 | A1 | 8/2008 | Raybould et al. | |
| 2012/0040084 | A1 * | 2/2012 | Fairbourn | C23C 16/24 427/8 |
| 2012/0324902 | A1 | 12/2012 | Pope et al. | |
| 2013/0059084 | A1 | 3/2013 | Fairbourn et al. | |

FOREIGN PATENT DOCUMENTS

| | | | | |
|---|---|---|---|---|
| EP | 1 079 073 | | 2/2001 | |
| EP | 1 209 247 | | 5/2002 | |
| EP | 2014791 | A1 | 1/2009 | |
| EP | 2551370 | A1 * | 1/2013 | C23C 10/04 |
| EP | 2551370b | A1 | 1/2013 | |
| JP | 576014 | A | 4/1982 | |
| JP | 7060147 | A | 4/1982 | |
| JP | 8260147 | A | 10/1996 | |
| WO | 2007009190 | A1 | 1/2007 | |

* cited by examiner

APPARATUS AND METHODS FOR SLURRY ALUMINIDE COATING REPAIR

FIELD OF THE INVENTION

The present invention relates generally to apparatus and methods for forming aluminide coatings. More particularly, this invention relates to forming an aluminide coating on a surface of a gas turbine component suitable for use in a high temperature environment.

BACKGROUND OF THE INVENTION

The operating environment within a gas turbine engine is both thermally and chemically hostile. Significant advances in high temperature capabilities have been achieved through the development of iron, nickel and cobalt-base superalloys and the use of oxidation-resistant environmental coatings capable of protecting superalloys from oxidation, hot corrosion, etc. Aluminum-containing coatings, particularly diffusion aluminide coatings, have found widespread use as environmental coatings on gas turbine engine components. Aluminide coatings are generally formed by a diffusion process such as pack cementation or vapor phase aluminizing (VPA) techniques, or by diffusing aluminum deposited by chemical vapor deposition (CVD) or slurry coating. During high temperature exposure in air, an aluminide coating forms a protective aluminum oxide (alumina) scale or layer that inhibits oxidation of the coating and the underlying substrate.

Slurry coatings used to form aluminide coatings contain an aluminum powder in an inorganic binder, and are directly applied to the surface to be aluminized. Aluminizing occurs as a result of heating the component in a non-oxidizing atmosphere or vacuum to a temperature that is maintained for a duration sufficient to melt the aluminum powder and diffuse the molten aluminum into the surface. Slurry coatings may contain a carrier (activator), such as an alkali metal halide, which vaporizes and reacts with the aluminum powder to form a volatile aluminum halide, which then reacts at the component surface to form the aluminide coating.

During a typical diffusion coating method, either CVD or slurry coating, the furnace is typically in a dynamic state with respect to the atmosphere within the furnace. For example, in both slurry and gel coating diffusion heat treating methods, a treatment cycle is typically performed using a vacuum furnace. That is, there is typically a pumping system attached to the exhaust system of the furnace to remove gas from the furnace, to keep gas flowing and/or to maintain a reduced pressure within the furnace.

However, the necessary components associated with such a dynamic system (e.g., furnace walls, heat zone, pump lines, oil, booster and mechanical pumps, blower motor, etc.) are exposed to the deposition and reaction gases. Such exposure can result in activator deposits on the components within the dynamic system, which can significantly shorten their working life span and cause multiple manufacturing issues and delays. As such, a need exists for an improved diffusion coating method to form and repair aluminide coatings.

BRIEF DESCRIPTION OF THE INVENTION

Aspects and advantages of the invention will be set forth in part in the following description, or may be obvious from the description, or may be learned through practice of the invention.

Methods are generally provided for deposition of an aluminide coating on an alloy component positioned within a coating compartment of a retort chamber. In one embodiment, the coating compartment is purged with an inert gas via a first gas line; a positive pressure is created within the coating compartment utilizing the inert gas; the coating compartment is heated to a deposition temperature; and at least one reactant gas is introduced into the coating compartment while at the positive pressure and the deposition temperature to form an aluminide coating on a surface of the alloy component.

Retort coating apparatus are also generally provided. In one embodiment, the retort coating apparatus includes a retort chamber positioned within a furnace and defining a coating compartment for receiving an alloy substrate; an insulated cover configured to seal the coating compartment such that the coating atmosphere within the coating compartment is isolated; a gas inlet connected to inlet piping and an inlet valve; a gas outlet connected to outlet piping and an outlet valve; and a pressure control system connected to the inlet valve and the outlet valve. Generally, the gas inlet, the inlet piping, and the inlet valve are configured to control inflow of a gas into the coating compartment, while the gas outlet, the outlet piping, and the outlet valve are configured to control flow of a gas out of the coating compartment.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
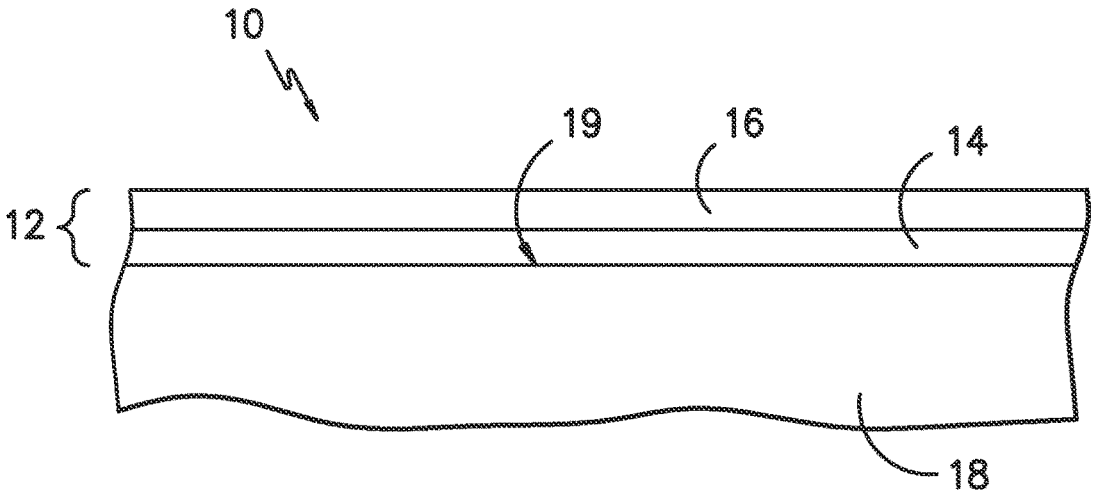
FIG. 1 shows a cross-sectional view of an exemplary turbine component.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The apparatus and methods provided here are generally applicable to components that operate within thermally and chemically hostile environments, and are therefore subjected to oxidation, hot corrosion and thermal degradation. Examples of such components include the high and low pressure turbine nozzles, blades and shrouds of gas turbine engines. While the advantages of this invention will be described with reference to gas turbine engine hardware, the teachings of the invention are generally applicable to any component on which an aluminide coating is used to protect the component from its hostile operating environment. In certain embodiments, a thermal barrier coating (TBC) may also be positioned on aluminide coating.

FIG. 1 represents a partial cross-section of a gas turbine engine component 10, such as a turbine blade, is constructed with an alloy component 18. Generally, the surface of the alloy component 18 is protected by an aluminide coating 12 that is formed to a diffusion depth 19. The aluminide coating 12 is shown as including an interdiffusion zone 14 and an additive zone 16, with the interdiffusion zone 14 being positioned between the alloy component 18 and the additive zone 16. Typical materials for the alloy component 18 include, in certain embodiments, nickel-based, iron-based, and cobalt-based superalloys, though other alloys or ceramic matrix composites (CMCs) could be used.

The aluminide coating 12 may be formed by utilizing the retort coating apparatus described in greater detail below. The aluminide coating 12 may be modified with elements such as hafnium, zirconium, yttrium, silicon, titanium, tantalum, cobalt, chromium, platinum, and palladium, and combinations thereof, to improve corrosion resistance and other properties of the component 10. Generally, the aluminum (and modifying elements, if any) is interdiffused with the material of the component 18 to form the aluminide coating 12. The aluminide coating 12 has a composition with the aluminum concentration highest near the surface, and a decreasing aluminum concentration with increasing distance into the substrate 18 from the surface, such that the lowest aluminum concentration is found at the diffusion depth 19. When exposed to a high-temperature oxidizing environment, the diffusion coating 12 oxidizes to form an adherent aluminum oxide protective scale at the surface, inhibiting and slowing further oxidation damage to the component 18.

Figure 2:
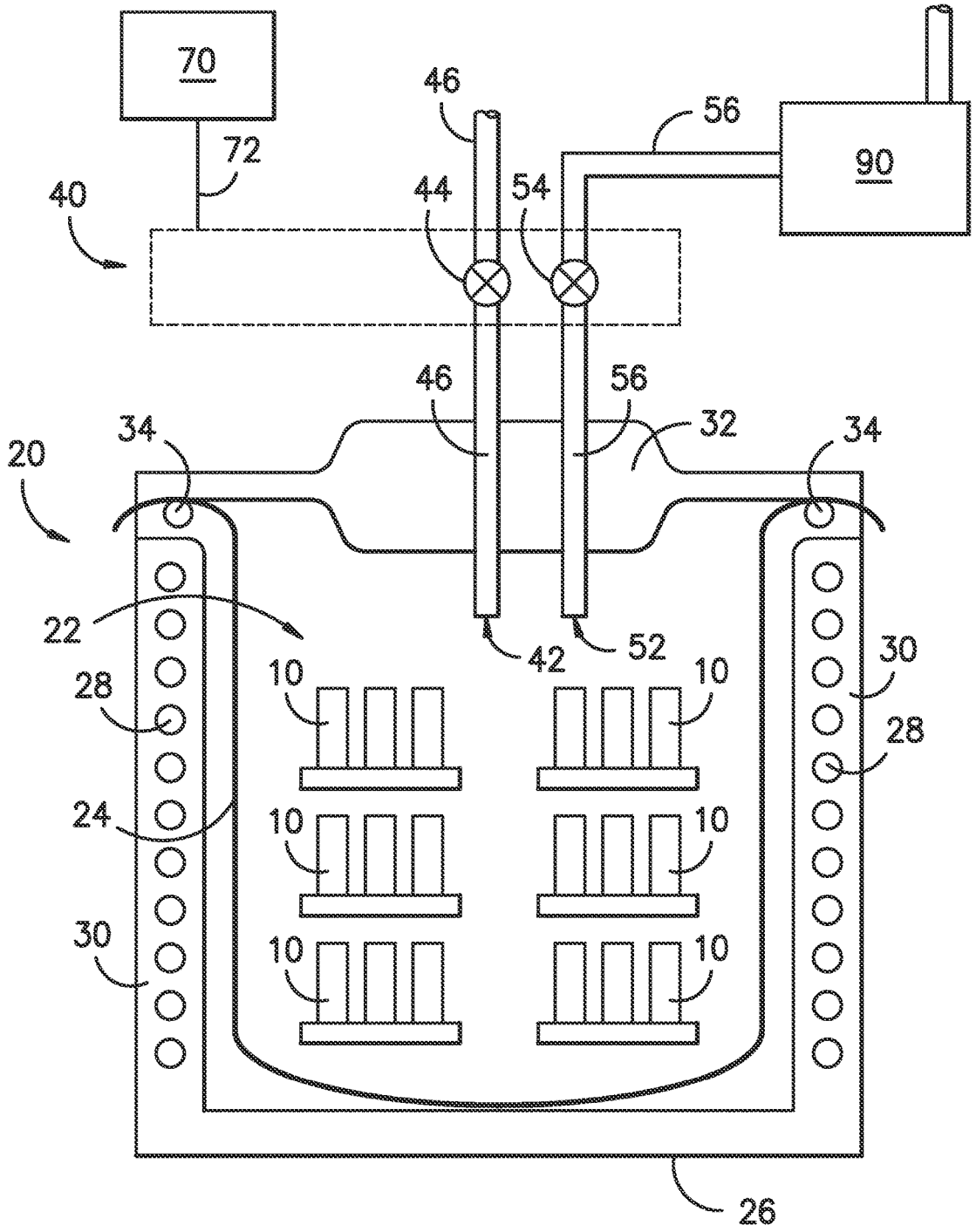
FIG. 2 shows a general schematic of an exemplary retort coating apparatus.

A retort coating apparatus and method is generally provided for applying the aluminide coating 12 via diffusion heat treatment onto the alloy component 18. Generally, the aluminide coating 12 is applied via a diffusion heat treating in an inert atmosphere enclosure having a positive pressure therein (i.e., greater than atmospheric pressure) to form an outwardly aluminide coating 12 on the surface 19. Referring to FIG. 2, a schematic of an exemplary retort coating apparatus 20 is shown, and can be utilized to deposit and/or repair an aluminide coating 12 on a component 10.

The retort coating apparatus 20 includes a coating compartment 22 defined by a retort chamber 24. The retort chamber 24 is positioned within a furnace 26 having heating elements 28 positioned to heat the furnace walls 30. As shown, the heating elements 28 are positioned within the furnace walls 30, but, in other embodiments, may be positioned in any orientation so as to heat the furnace walls 30. The retort chamber 24 is positioned in close proximity or adjacent (e.g., in contact with) the furnace walls 28 such that the retort chamber 24 is heated within the furnace 26.

The alloy components 10 can be positioned within the coating chamber 22, and held or otherwise situated for diffusion heat treatment to form a coating on the surface 19.

A pressure control system 40 is associated with retort chamber to control gas flow into and out of the coating compartment. As shown, a gas inlet 42, an associated inlet valve 44, and inlet piping 46 are positioned to control the inflow of gas into the coating compartment 22. Conversely, a gas outlet 52, an associated outlet valve 54, and outlet piping 56 are positioned to control the outflow of gas (i.e., the exhaust) out of the coating compartment 22. Specifically, the pressure control system 40 is capable of controlling the inlet valve 44 and/or the outlet valve 54 in order to control the pressure within the coating compartment 22. For example, the outlet valve 54 can be a release valve configured to exhaust gas from the coating compartment 22 (via the outlet 52 and through the outlet piping 56) upon reaching a predetermined pressure within the coating compartment 22.

Figure 3:
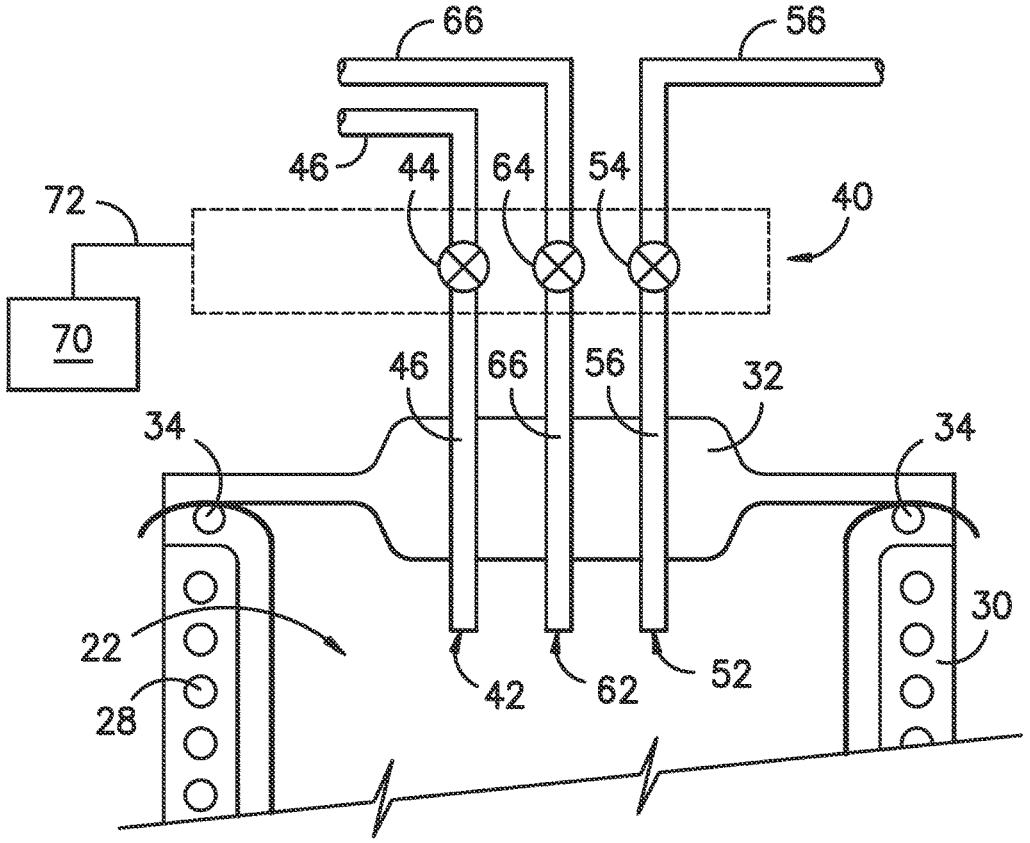
FIG. 3 shows a general schematic of an exemplary pressure control system and insulated cover for use in a retort coating apparatus as in FIG. 2.

Although shown in FIG. 2 as having a single inlet 42 and a single outlet 52, it is to be understood that any number of inlets and/or outlets can be utilized. For example, referring to FIG. 3, a pressure control system 40 is shown having a first inlet 42 and a second inlet 62 along with a second inlet valve 64 and associated second inlet piping 66. Through the use of multiple inlets, each having its own associated valve and piping, the partial pressure of the gaseous components within the coating compartment 22 can be controlled.

The pressure control system 40, in one embodiment, is controlled via a pressure controller 70 via connection 72, which can be a wired or wireless connection. It should be appreciated that the pressure controller 70 may generally comprise any suitable processing unit, such as a computer or other computing device. Thus, in several embodiments, the pressure controller 70 may include one or more processor(s) and associated memory device(s) configured to perform a variety of computer-implemented functions. As used herein, the term "processor" refers not only to integrated circuits referred to in the art as being included in a computer, but also refers to a controller, a microcontroller, a microcomputer, a programmable logic controller (PLC), an application specific integrated circuit, and other programmable circuits. Additionally, the memory device(s) of the pressure controller 70 may generally comprise memory element(s) including, but are not limited to, computer readable medium (e.g., random access memory (RAM)), computer readable non-volatile medium (e.g., a flash memory), a floppy disk, a compact disc-read only memory (CD-ROM), a magneto-optical disk (MOD), a digital versatile disc (DVD) and/or other suitable memory elements. Such memory device(s) may generally be configured to store suitable computer-readable instructions that, when implemented by the processor(s), configure the pressure controller 70 to perform various functions including, but not limited to, monitoring one or more pressure conditions within the coating compartment 22 and the partial pressure of the gaseous reactants. In addition, the pressure controller 70 may also include various input/output channels for receiving inputs from sensors and/or other measurement devices and for sending control signals to the various components of the pressure control system 40 (e.g., the inlet valves and/or outlet valves). For example, the outlet valve 54 can be set by the pressure control system 40 to exhaust gas from the coating compartment 22 (via the outlet 52 and through the outlet piping 56) upon reaching a predetermined pressure within the coating compartment 22.

After placing the alloy component(s) 10 within the coating compartment 22 of the retort chamber 24, the coating compartment 22 is sealed using the insulated cover 32. That is, the insulated cover 32 is positioned to seal the coating compartment 22 with the component 10 therein to isolate the coating atmosphere within the coating compartment 22 from the atmosphere outside of the retort chamber 24. Depending on the particular orientation of the apparatus 10, the insulated cover 32 can be an insulated lid, insulated door, or other suitable sealing apparatus. The insulated cover 32 is configured to be removable or hinged from an open configuration (not shown) exposing the coating compartment 22 and a sealed configuration (shown) providing a coating compartment 22 isolated from the surrounding atmosphere. An o-ring 34 is shown completing the seal between the insulated cover 32 and the retort chamber 24. As shown, the inlet piping 46 and the outlet piping 56 pass through the insulated cover 32 to control the coating atmosphere (i.e., pressure and composition) within the coating compartment 22. However, in other embodiments, the inlet piping 46 and outlet piping 56 can be routed through the furnace walls 30.

Once sealed, the coating compartment 22 can be purged with an inert gas, supplied via the gas inlet 42 and optionally exhausted through the gas outlet 52. Purging the coating compartment 22 with the inert gas prevents oxidation on the alloy component 10 during the diffusion heat treatment process.

Using the pressure control system 40, a positive pressure (i.e., greater than atmospheric pressure of 1.0 bar) is then created within the coating compartment 22 using the inert gas. For example, the positive pressure within the coating compartment 22 can be up to twice atmospheric pressure. That is, this positive pressure within the coating compartment is, in particular embodiments, about 1.05 bar to about 2.0 bar (e.g., about 1.1 bar to about 1.5 bar). This positive pressure can be maintained throughout the diffusion heat treatment process. It has been discovered that the deposition rate increases while the pressure is higher within the coating compartment 22.

Once purged, the retort chamber can be heated to begin the diffusion heat treatment process. Although grown in an outward manner onto the surface 19 of the alloy component 18, a portion of the aluminide coating 12 can diffuse into the near-surface region of the alloy component 18. For example, the deposition temperature within the coating compartment 22, heated using the heating elements 28 within the furnace walls 30, can be a temperature sufficient to diffuse the reactive species (aluminum, and/or, if present, chromium and/or other metallic species) into the near-surface regions of the surface 19. As used herein, a "near-surface region" extends to a depth of up to about 200 micrometers (μm) into the surface 19 of the alloy component 18, typically a depth of about 75 μm and preferably at least 25 μm into the surface 19, and includes both an aluminum-enriched region closest to the surface 19 and an area of interdiffusion immediately below the enriched region. Temperatures required for this diffusive step (i.e., the diffusion temperature) will depend on various factors, including the composition of the alloy component 18, the specific composition and thickness of the slurry, and the desired depth of diffusion.

Usually the diffusion temperature within the coating chamber 22 is within the range of about 650° C. to about 1100° C. (i.e., about 1200° F. to about 2012° F.), and preferably about 800° C. to about 950° C. (i.e., about 1472° F. to about 1742° F.). These temperatures are also high enough to completely remove (by vaporization or pyrolysis) any organic compounds present, including stabilizers such as glycerol.

The time required for the diffusion heat treatment will depend on many of the factors described above. Generally, the time will range from about thirty minutes to about eight hours. In some instances, a graduated heat treatment is desirable. As a very general example, the temperature could be raised to about 650° C. (about 1200° F.), held there for a period of time, and then increased in steps to about 850° C. (about 1562° F.). Alternatively, the temperature could initially be raised to a threshold temperature such as 650° C. (about 1200° F.), and then raised continuously, e.g., about 1° C. per minute, to reach a temperature of about 850° C. (about 1562° F.) in about 200 minutes. Those skilled in the general art (e.g., those who work in the area of pack-aluminizing) will be able to select the most appropriate time-temperature regimen for a given substrate and slurry.

Figure 4:
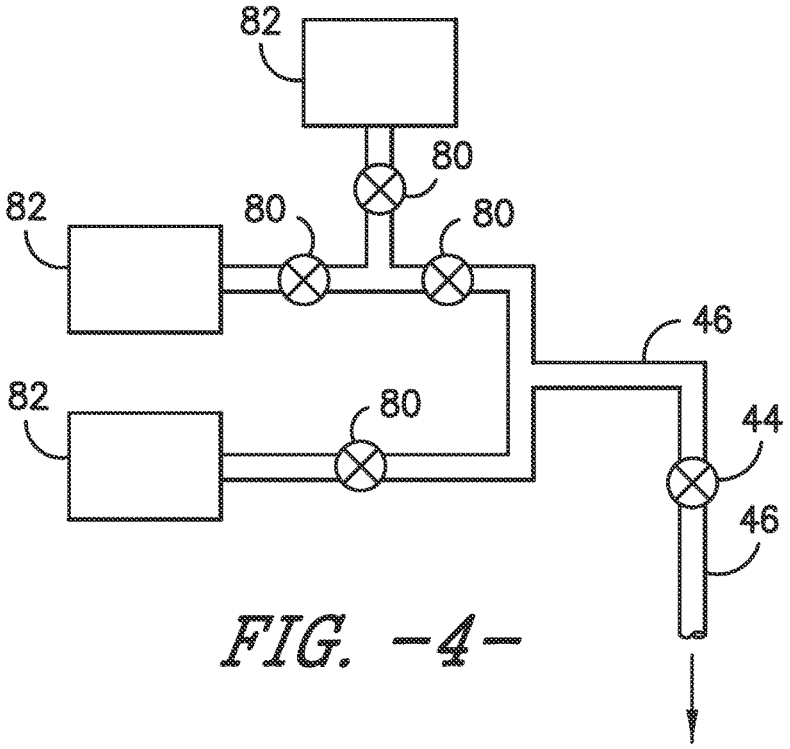
FIG. 4 shows a general schematic of an exemplary gas control system for controlling the partial pressure of different gas species introduced into the coating compartment.
Figure 5:
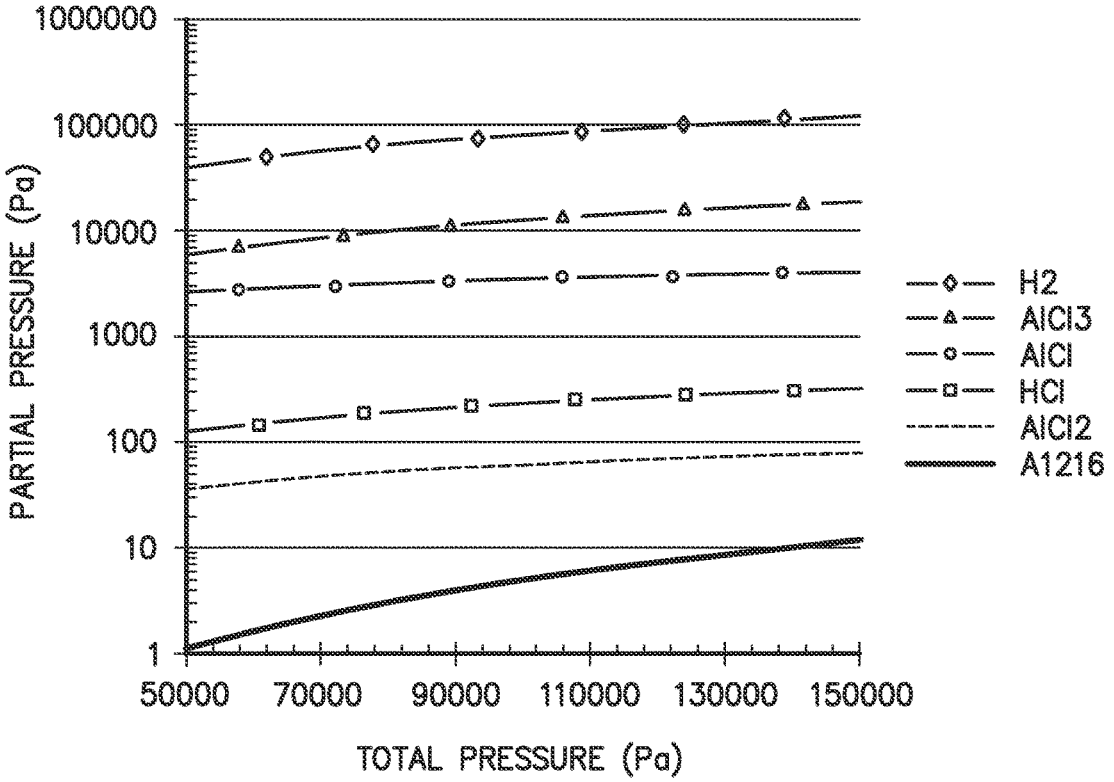
FIG. 5 shows a thermodynamic calculation for a simulated coating system in retort coating apparatus, such as shown in FIG. 2, operating at about 1080° C. (about 1975° F.) for various gas species.
Figure 6:
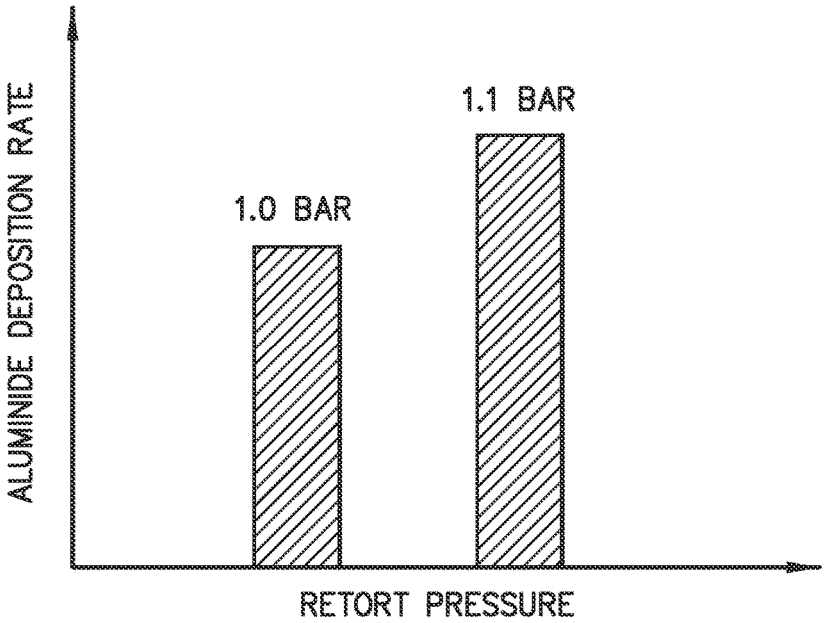
FIG. 6 shows preliminary results for gel diffusion coating under a positive pressure.

The reactive gas species can be introduced into the coating compartment 22 at the desired reaction temperature and deposition pressure within the coating compartment 22. Referring to FIG. 4, an exemplary gas mixing schematic is shown for introducing additional gas species into a gas stream through the gas inlet piping 46. As shown, a series of valves 80 can be controlled via the pressure control system 40 to supply gas species from the respective gas tanks 82. Thus, the type of gas and the partial pressure of each gas species can be controlled and supplied into the coating compartment 22 via the gas inlet 46. It should be understood that one of ordinary skill in the art could change the configuration and/or number of valves 80, associated piping, and gas tanks 82 to control the flow of respective gas species through the gas inlet piping 46.

To form the aluminide coating on a surface of the alloy component via a diffusion heat treatment method, the alloy component 10 is exposed to at least one reactant gas within the coating compartment while at the positive pressure and the deposition temperature. Any suitable reactive species can be introduced into the coating compartment 22. As such, the deposition method can be used to form all types of slurry diffusion coatings for both internal passage and external surfaces of bucket, nozzles, and other alloy components typically used in a gas turbine engine.

For example, aluminide coatings can be formed through metal halide generating reactions, such as shown in Reaction Scheme 1 and Reaction Scheme 2 below:

Reaction Scheme 1: Metal Halide Generating Reactions $$NH_4Cl \leftrightarrow NH_3+HCl$$

$$4HCl+AlCr \leftrightarrow AlCl+CrCl_3+2H_2$$

$$10HCl+2AlCr \leftrightarrow 2AlCl_2+2CrCl_3+5H_2$$

$$6HCl+AlCr \leftrightarrow AlCl_3+CrCl_3+3H_2$$

Reaction Scheme 2: Aluminide Deposition Reactions $$3AlCl_x+2Ni+x/2H_2 \leftrightarrow Al_3Ni_2+3x\ HCl$$

$$AlCl_x+2Ni+x/2H_2 \leftrightarrow AlNi_3+x\ HCl$$

In these reaction schemes, the aluminide deposition rate and aluminum content of nickel aluminide is a function of partial pressure of AlCl, $AlCl_2$ and $AlCl_3$ metal halide. The partial pressure of AlCl, $AlCl_2$ and $AlCl_3$ metal halide is also a function of the retort pressure in a closed system.

Referring again to FIG. 2, a scrubber system 90 is positioned upstream of the outlet valve 54 and is configured to remove reactant gas and/or other harmful gas species from the exhaust stream.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for deposition of an aluminide coating on an alloy component positioned within a coating compartment of a retort chamber, the method comprising:

purging the coating compartment with an inert gas via a first gas line;

creating a positive pressure within the coating compartment utilizing the inert gas, wherein the positive pressure within the coating compartment is about 1.05 bar to about 2.0 bar;

heating the coating compartment to a deposition temperature; and introducing at least one reactant gas into the coating compartment while at the positive pressure and the deposition temperature to form an aluminide coating on a surface of the alloy component.

2. The method of claim 1, further comprising, prior to purging the coating compartment:

placing the alloy component within the coating compartment of the retort chamber; and thereafter, closing the coating compartment of the retort chamber with an insulated cover such that the coating compartment is atmospherically isolated.

3. The method of claim 1, further comprising:

controlling the positive pressure within the coating compartment with a pressure control system, wherein the pressure control system comprises: at least one gas inlet and associated inlet valve; and an exhaust outlet and associated outlet valve.

4. The method of claim 3, wherein the outlet valve is a release valve configured to exhaust gas from the coating compartment at a predetermined pressure.

5. The method of claim 1, wherein the positive pressure within the coating compartment is about 1.1 bar to about 1.5 bar.

6. The method of claim 1, wherein the deposition temperature of about 650° C. to about 1100° C.

7. The method of claim 1, wherein heating the coating compartment is achieved using a plurality of heating elements positioned to heat the coating compartment.

8. The method of claim 7, wherein the plurality of heating elements are positioned within furnace walls of the coating compartment.

9. The method of claim 2, wherein the first gas line passes through an insulated cover.

10. The method of claim 3, wherein the pressure control system is in communication with the inlet valve so as to control the pressure within the retort chamber.

11. The method of claim 3, wherein the pressure control system is in communication with the outlet valve so as to control the pressure within the retort chamber.

12. The method of claim 11, wherein the outlet valve is a release valve configured to exhaust gas from the coating compartment upon reaching a predetermined pressure controllable by the pressure control system.

13. The method of claim 12, wherein the predetermined pressure is about 1.05 bar to about 2.0 bar.

14. The method of claim 12, wherein the predetermined pressure is about 1.1 bar to about 1.5 bar.

* * * * *